US008757766B2

(12) United States Patent
Suzuki et al.

(10) Patent No.: US 8,757,766 B2
(45) Date of Patent: Jun. 24, 2014

(54) INK JET RECORDING APPARATUS

(75) Inventors: Seiji Suzuki, Ebina (JP); Hiroyuki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/499,499

(22) Filed: Jul. 8, 2009

(65) Prior Publication Data

US 2010/0033531 A1 Feb. 11, 2010

(30) Foreign Application Priority Data

Aug. 7, 2008 (JP) ..... 2008-204522
May 15, 2009 (JP) ..... 2009-118976

(51) Int. Cl.
*B41J 2/165* (2006.01)

(52) U.S. Cl.
USPC ..... 347/29

(58) Field of Classification Search
None
See application file for complete search history.

(56) References Cited

U.S. PATENT DOCUMENTS 6,286,930 B1 * 9/2001 Kobayashi et al. ..... 347/29
6,913,340 B2 * 7/2005 Tanaka et al. ..... 347/29
2008/0001988 A1 1/2008 Tanaka ..... 347/32

FOREIGN PATENT DOCUMENTS

CN 101100132 1/2008
JP 2005-111686 4/2005
JP 2008-012684 A 1/2008

OTHER PUBLICATIONS

Chinese Office Action dated Aug. 4, 2010 in corresponding Chinese Application No. 200910163625.9, with English translation.

* cited by examiner

*Primary Examiner* — Alejandro Valencia
(74) *Attorney, Agent, or Firm* — Fitzpatrick, Cella, Harper & Scinto

(57) ABSTRACT

When recording heads are away from caps, a black ink recording head is first set into a capping state and a color ink recording head is subsequently set into a capping state from this state. When the recording heads are adhered to the caps, the capping state of the color ink recording head is first cancelled and the capping state of the black ink recording head is subsequently cancelled from this state.

9 Claims, 9 Drawing Sheets

INK JET RECORDING APPARATUS

BACKGROUND OF THE INVENTION

1. Field of the Invention

The present invention relates to an ink jet recording apparatus for discharging ink to a recording medium from a recording head mounted to a carriage and recording.

2. Description of the Related Art

In an ink jet recording apparatus, ink droplets are discharged from a plurality of fine nozzles formed in a recording head. There is a case where the ink in the nozzle is dried, thickened, and stuck with the elapse of time. Paper fine particles, dust, bubbles, or the like are mixed into the ink in the nozzle, or the like, so that there is a case of occurrence of deterioration in recording quality due to a defective ink discharge caused by a clogging.

To solve such a problem, an apparatus disclosed in Japanese Patent Application Laid-Open No. 2005-111686 has a capping mechanism of a slide cap system in which when a carriage equipped with a recording head is moved to an area adjacent to a recording area, capping of the recording head is performed in response to the movement of the carriage. In the apparatus disclosed in the above Official Gazette, a slider equipped with a cap ascends or descends along a cam surface provided by setting an apparatus frame to a reference and a plurality of recording heads and a plurality of caps are simultaneously come into contact with and adhered to each other, thereby performing the capping. When the capping is cancelled, the plurality of recording heads and the plurality of caps are simultaneously separated so as to be away from each other.

To suppress the drying of the ink, it is necessary to certainly adhere the cap and the recording head. There is a case where the recording head and the cap are excessively adhered in dependence on a preserving state. When separating the adhered recording head and cap, a driving load of a driving mechanism increases. Particularly, when the capping operations (adherence or separation) of the plurality of recording heads are simultaneously performed, a driving load of the carriage increases temporarily and remarkably.

The apparatus disclosed in the above Official Gazette has a mechanism in which when the carriage is moved on the further back side (in such a direction as to be away from the recording area) rather than a capping position, the capping of only one cap is selectively cancelled. However, when the carriage is returned from such a position to the recording area side, it is temporarily returned to a state where both of the plurality of recording heads and the plurality of caps are adhered to each other. Subsequently, the plurality of recording heads and the plurality of caps are simultaneously separated so as to be away from each other, and thereafter, the carriage is returned to the recording area. That is, the apparatus disclosed in the above Official Gazette has a construction in which since the position where all of the plurality of recording heads and the plurality of caps are adhered to each other is located on the side near the recording area, the concurrent adherence and separation of the plurality of recording heads and the plurality of caps occur certainly. Therefore, it is unavoidable that the driving load of the carriage increases.

SUMMARY OF THE INVENTION

The invention is made based on the recognition of the foregoing problems and it is an object to improve the apparatus in the related art. An example of a further specific object of the invention is to disperse a driving load when a plurality of caps and a plurality of recording heads are adhered to each other or separated so as to be away from each other in a capping mechanism of a slide cap system. According to the invention, there is provided an ink jet recording apparatus comprising a carriage on which a first recording head and a second recording head are mounted and which can move in a moving direction within a range including a recording area, a first cap which can be adhered to the first recording head for capping, a second cap which can be adhered to the second recording head for capping, a first holder which holds the first cap, a second holder which holds the second cap, and a slider on which the first holder and the second holder are mounted and which can move in the moving direction with the carriage and a direction of a gap between the first recording head and the first cap in an area different from the recording area, wherein the carriage can move to a first capping position and to a second capping position, the first capping position is a position at which a first state where the first recording head and the first cap are adhered and the second recording head and the second cap are adhered is obtained, and a second capping position is a position at which a second state where the second recording head and the second cap are adhered and the first recording head and the first cap are not adhered is obtained, and wherein the second capping position is closer to the recording area than the first capping position.

The above and other objects, effects, features and advantages of the present invention will become more apparent from the following description of embodiments thereof taken in conjunction with the accompanying drawings.

Further features of the present invention will become apparent from the following description of exemplary embodiments with reference to the attached drawings.

DESCRIPTION OF THE EMBODIMENTS

Figure 1:
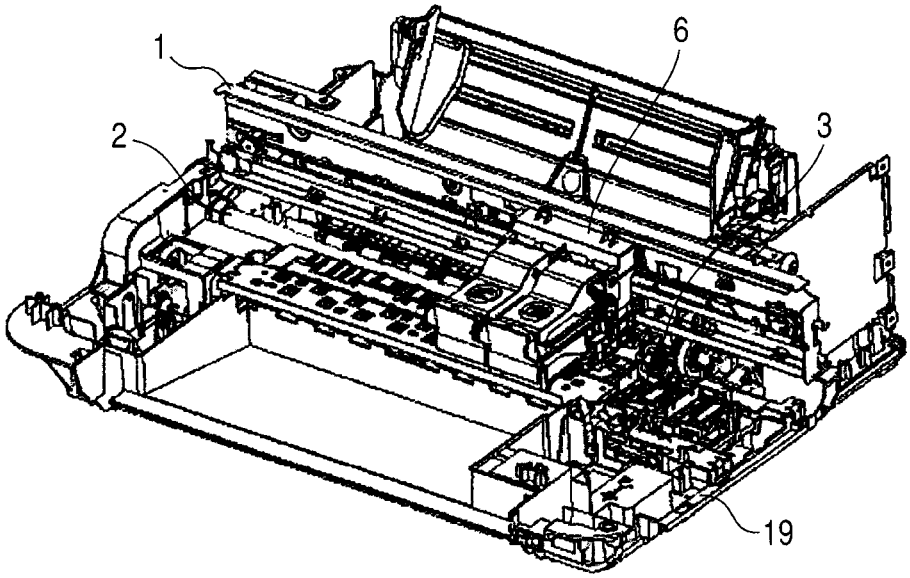
FIG. 1 is a perspective view illustrating a construction of an ink jet recording apparatus according to an embodiment of the present invention.

An exemplary embodiment of the invention will be specifically described hereinbelow with reference to the drawings. In all of the drawings, the same or corresponding portions are designated by the same reference numerals.

FIG. 1 is an external view of an ink jet recording apparatus according to an embodiment of the invention. A color ink recording head 7 which can discharge ink of a plurality of colors such as yellow, magenta, cyan, and the like and a black ink recording head 8 which can discharge monochromatic ink of black or the like are mounted on a carriage 6. The carriage 6 repeats the reciprocating movement in the main scanning direction for a chassis 1. Each time the main scan of the carriage 6 is finished, a conveying roller 2 conveys a recording medium (sheet) in the sub-scanning direction and those operations are repetitively executed, thereby performing the print-recording (image formation, printing, or the like) to a recording sheet.

Figure 2:
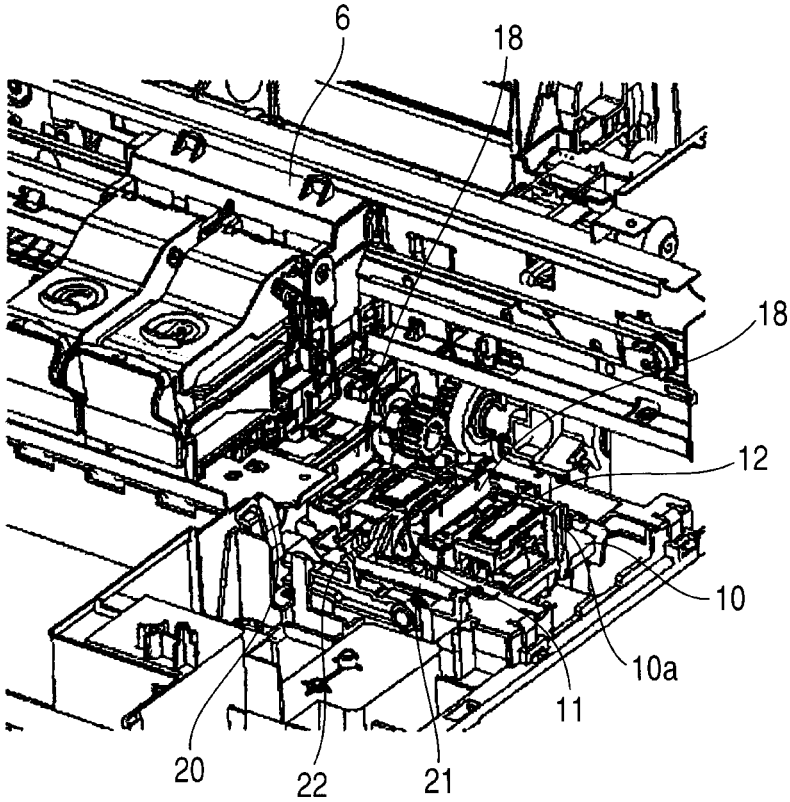
FIG. 2 is a perspective view illustrating a construction of a cleaning mechanism portion and a carriage and is a diagram seen from an upper surface side.
Figure 3:
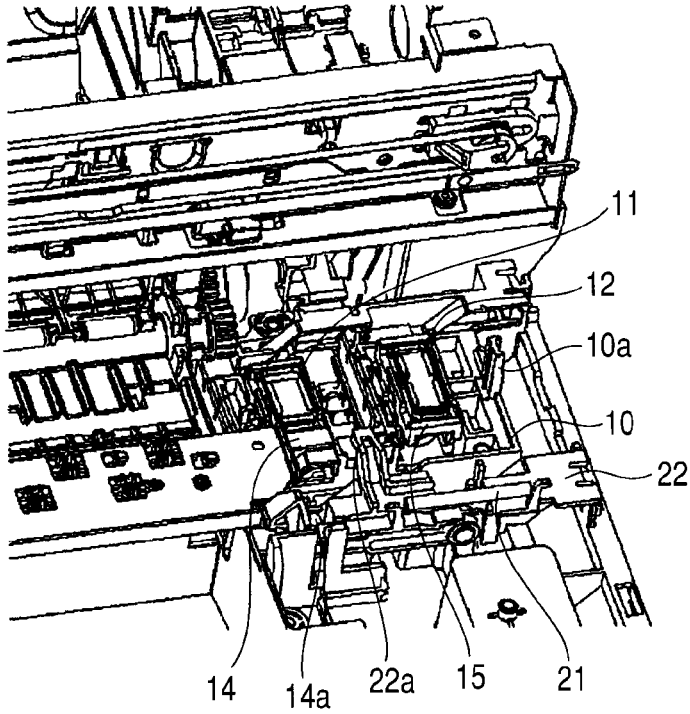
FIG. 3 is a perspective view illustrating the cleaning mechanism portion and is a diagram seen from the upper surface side.

At an outer position which is adjacent to a recording area (recording area where the sheet is printed) in the main scanning direction, a cleaning mechanism portion is provided so as to face the carriage. FIGS. 2 and 3 are schematic perspective views illustrating the cleaning mechanism portion. In the cleaning mechanism portion, caps 11 and 12 which can cap the recording heads 7 and 8 are held to a slider 10 through cap holders 14 and 15, respectively.

According to the operation in the reciprocation moving direction of the carriage 6, the slider 10 can slide in the outer area of the recording area along a cam surface 19*a* provided for a base 19 in which an apparatus frame is set to a reference. In addition, the slider 10 can move in the direction (ink discharge direction) perpendicular to the discharge surface of each of the color ink recording head 7 and the black ink recording head 8. By the movement of the slider 10 in the perpendicular direction, the approach (adherence) and the separation between the caps 11 and 12 and nozzle surfaces of the recording heads 7 and 8 can be performed. That is, the cap holders 14 and 15 are mounted on the slider 10 and the slider 10 can move both in the moving direction of the carriage and in the direction of a gap between the recording heads 7 and 8 and the caps 11 and 12 in the area different from the recording area according to the movement of the carriage 6.

Pump tubes 13*a* and 13*b* are coupled with the caps 11 and 12, respectively. The pump tubes 13*a* and 13*b* are connected to a sucking pump (pump mechanism portion) serving as a negative pressure generating unit.

Figure 4:
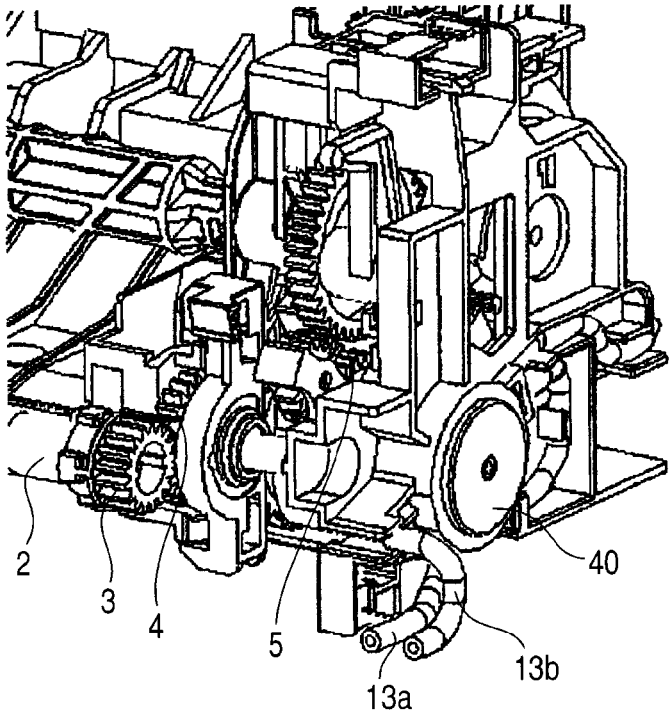
FIG. 4 is a perspective view illustrating a drive transfer construction in a range from a conveying roller to a pump mechanism portion.
Figure 5:
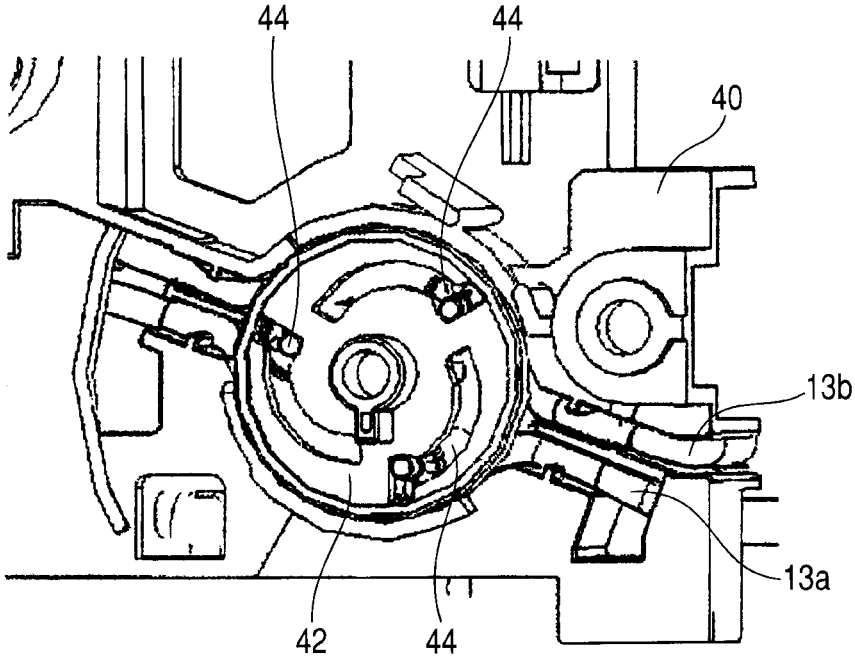
FIG. 5 is a perspective view illustrating the pump mechanism portion.

FIGS. 4 and 5 illustrate a construction of the pump mechanism portion for supplying a negative pressure to the caps 11 and 12. FIG. 4 is the perspective view illustrating the pump mechanism portion when seen from the coupling side with a driving gear train. FIG. 5 is the external perspective view of the pump mechanism portion. Pump rollers 44 are attached to a pump roller holder 42. The pump tubes 13*a* and 13*b* are rotatably inserted into a pump base 40 so as to creep along an inner wall of the pump base 40 by an amount of the half circumference.

When the conveying roller 2 is reversely rotated in a state where the recording heads 7 and 8 have been capped, a driving force is propagated to the pump roller holder 42 through an output gear 3, an idler gear 4, and a pump driving gear 5. The pump rollers 44 move a cam provided for the pump roller holder 42, so that a state where the pump tubes 13*a* and 13*b* are crushed by the inner wall of the pump base 40 and the pump roller 44 is obtained. When the reverse rotation of the conveying roller 2 is further continued, the negative pressure is generated in the pump tubes. If both of the cap 11 and the recording head 7 and the cap 12 and the recording head 8 are in the capping state where they are hermetically adhered, the ink can be sucked from ink nozzles of the recording heads 7 and 8 through the caps 11 and 12.

In the case of cancelling the negative pressure in the pump tubes after completion of the ink sucking operation, the pump roller holder 42 is reversely rotated (the conveying roller is rotated on the forward rotation side). Since the pump roller 44 operates so as to release the crushing operation of the pump tubes 13*a* and 13*b*, the negative pressure in the pump tubes can be cancelled.

Figure 6:
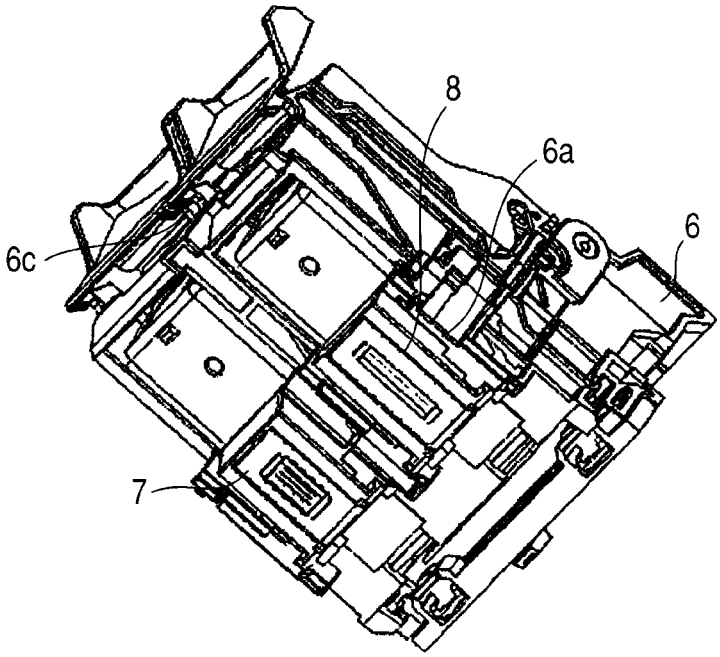
FIG. 6 is a perspective view illustrating a state where a color ink recording head and a black ink recording head are mounted on the carriage and is a diagram seen from a lower surface side.

FIG. 6 is a perspective view of the carriage 6 on which the color ink recording head 7 and the black ink recording head 8 are mounted and is a diagram seen from the ink nozzle surface side. There are various kinds of elements in conditions for executing the sucking and preliminary discharging operations of the ink in order to clean the recording head. In a recording head in which pigment black ink is contained, there is such a tendency that the ink is more liable to be thickened and stuck as compared with the case of using dye ink. Therefore, in the case of executing the recording operation after the capped state was continued for a predetermined period of time, a method whereby the sucking operation is executed prior to starting the recording operation, the thickened ink is removed from the ink nozzle, and good recording quality is maintained is used.

In a recording head in which the dye ink is contained, even if the capping is executed for a long period of time, the ink is more difficult to be thickened and stuck as compared with the case of using the pigment ink. Therefore, in the normal using state, there is no need to execute the ink sucking operation. However, when the recording operation has continuously been executed, if a predetermined amount of ink is discharged during the recording operation in order to decrease an influence on the ink discharge due to ink mist deposition onto an ink discharge surface, the preliminary discharging operation is executed and the wiping operation is executed, thereby stabilizing the recording quality. There is also another case where when the ink discharge from the recording head is unstable due to some reasons, the ink sucking operation is executed based on a judgment of the user of the recording apparatus, or the like.

Figure 7:
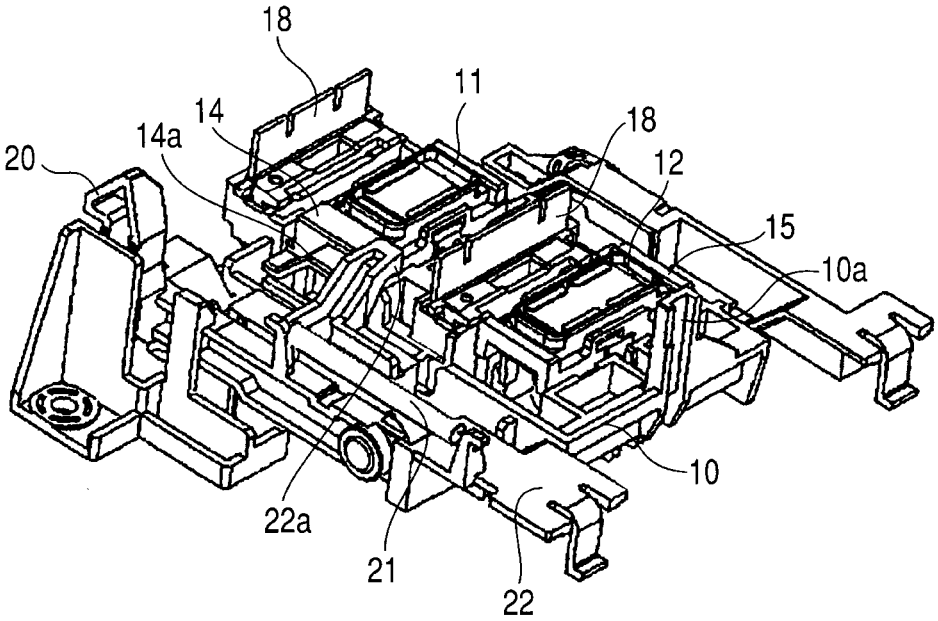
FIG. 7 is a perspective view illustrating a construction of a slider portion serving as a cleaning mechanism portion and is a diagram seen from the upper surface side.

FIG. 7 illustrates details of a cleaning mechanism portion. The caps 11 and 12 which are adhered to the ink recording heads and cap them are attached to the cap holders 14 and 15. The cap holders 14 and 15 are held in a state where their heights are restricted so as not to be detached even in a state where a pressure of a cap spring has been applied to the slider 10 by a retaining claw portion. When the carriage 6 exists in the recording area, the slider 10 is urged in such a direction as to move from the outside of the recording area to the recording area side by a slider spring (urging unit) provided between the apparatus frame and the slider 10 and is at rest.

Figure 8:
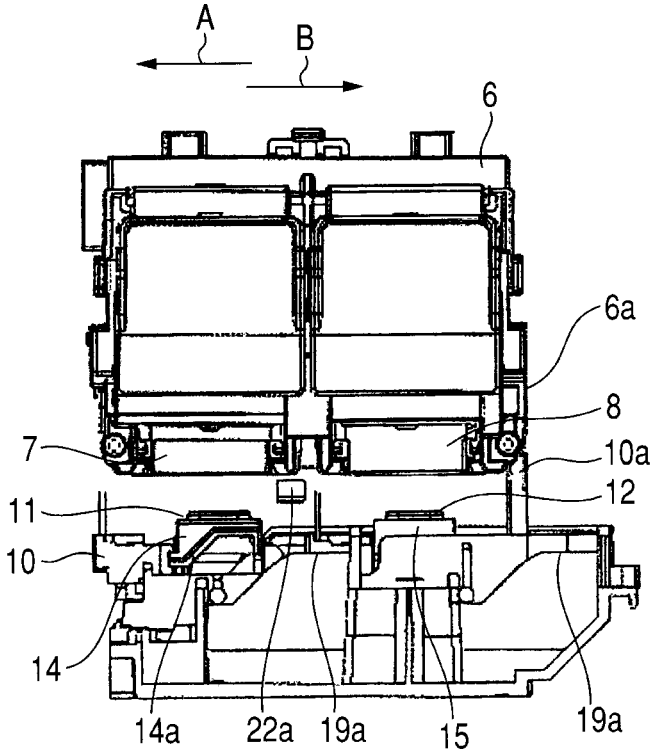
FIG. 8 is a schematic diagram illustrating a positional relation between the carriage and the cleaning mechanism portion in a state where the slider is urged to a recording area side and is a diagram seen from the front side.
Figure 9:
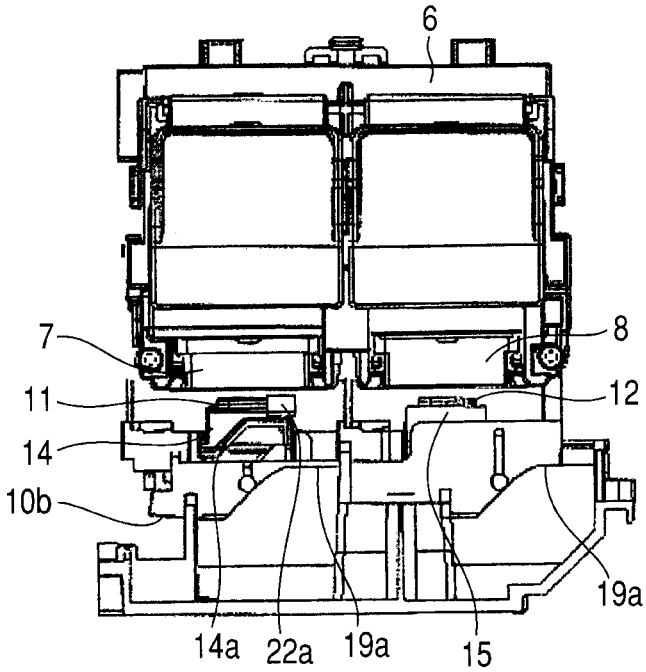
FIG. 9 is a schematic diagram illustrating a positional relation between the carriage and the cleaning mechanism portion in a state where a cap holder cam portion and a cover member pressing portion are come into contact with each other and is a diagram seen from the front side.
Figure 10:
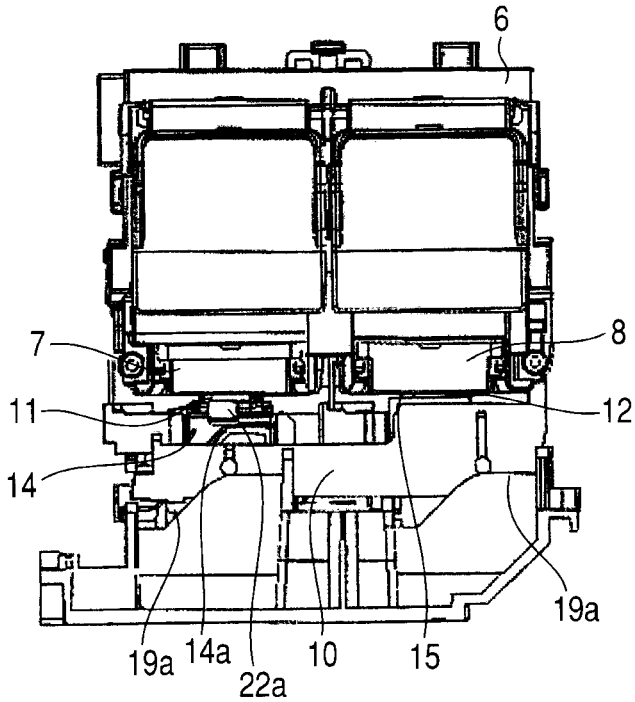
FIG. 10 is a schematic diagram illustrating a positional relation between the carriage and the cleaning mechanism portion at a second capping position and is a diagram seen from the front side.
Figure 11:
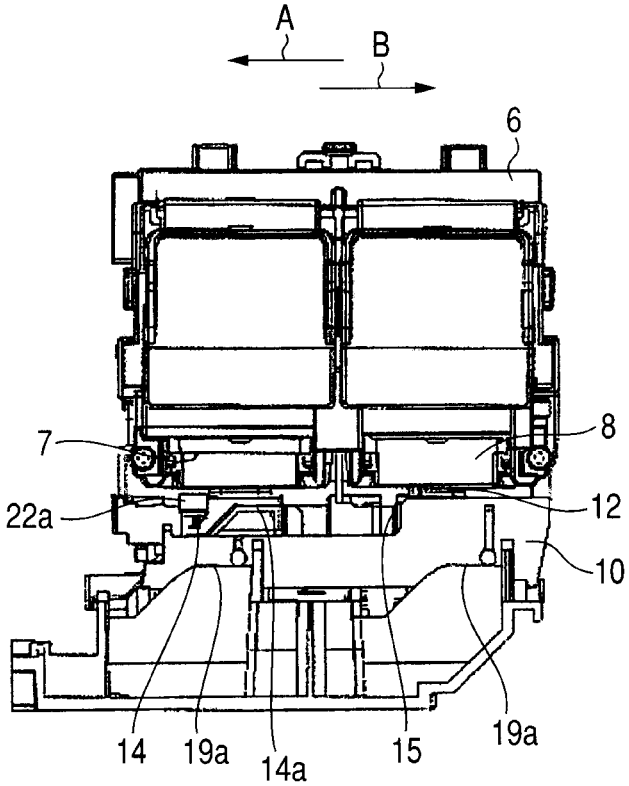
FIG. 11 is a schematic diagram illustrating a positional relation between the carriage and the cleaning mechanism portion at a first capping position and is a diagram seen from the front side.
Figure 12:
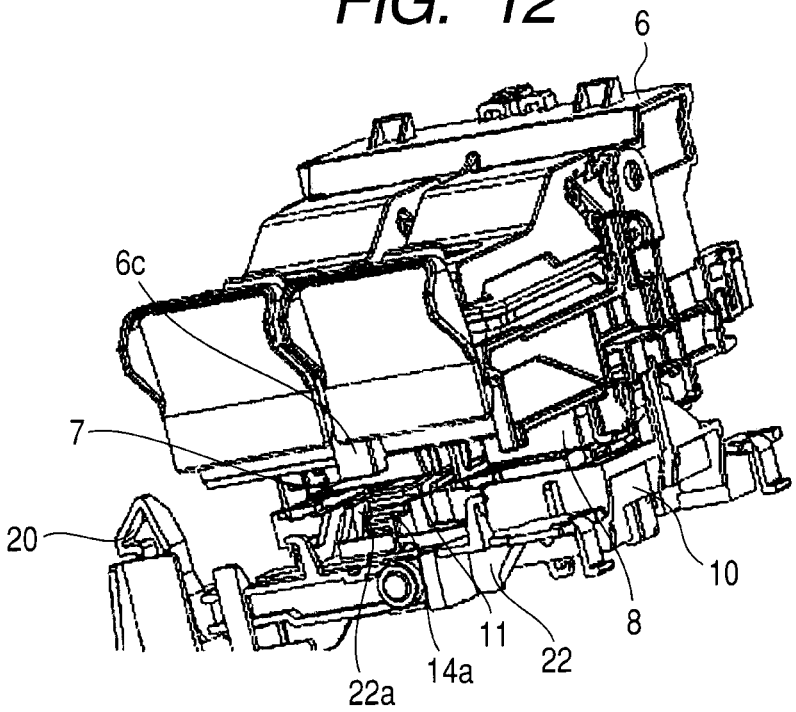
FIG. 12 is a schematic diagram illustrating the positional relation between the carriage and the cleaning mechanism portion in FIG. 10 and is a diagram seen from the upper surface side.

FIGS. 8 to 15 are front views illustrating a positional relation between the carriage 6 and the slider 10 at the time of executing the cleaning operation of the recording heads 7 and 8. FIG. 8 illustrates the positional relation among the carriage 6, slider 10, and base cam surface 19*a* in a state where the slider 10 has been urged to the recording area side. FIG. 9 illustrates the positional relation among the carriage 6, slider 10, and base cam surface 19*a* in a state where a cap holder cam portion 14*a* is come into contact with a pressing portion 22*a*. FIGS. 10 and 12 illustrate the positional relations among the carriage 6, slider 10, and base cam surface 19*a* in a state where the black ink recording head 8 and the cap 12 are hermetically adhered and the color ink recording head 7 and one end of the cap 11 are separated so as to be away from each other without being adhered (such a state is referred to as a second capping state). The positions of the carriage 6 and the slider 10 in this state are referred to as a second capping position.

Figure 13:
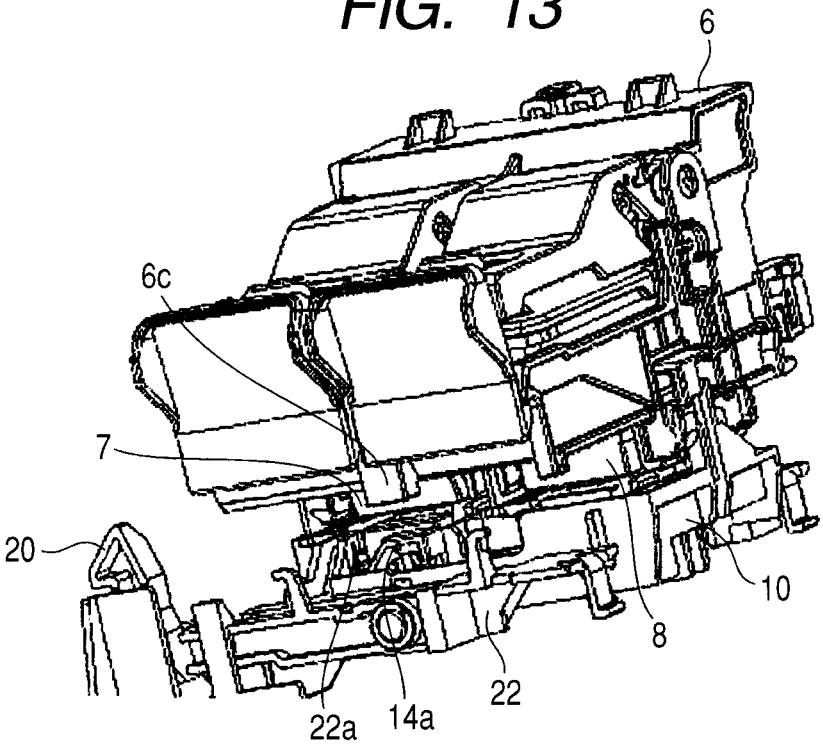
FIG. 13 is a schematic diagram illustrating the positional relation between the carriage and the cleaning mechanism portion in FIG. 11 and is a diagram seen from the upper surface side.

FIGS. 11 and 13 illustrate the positional relations among the carriage 6, slider 10, and base cam surface 19*a* in a state where the color ink recording head 7 and the black ink recording head 8 are respectively hermetically adhered to the caps 11 and 12 (such a state is referred to as a first capping state). The positions of the carriage 6 and the slider 10 in this state are referred to as a first capping position.

The capping operation for adhering the recording heads and the caps from a state where the black ink recording head 8 and the color ink recording head 7 and the caps 12 and 11 are away from each other will now be described. The carriage 6 and the slider 10 in the capping operation are moved so as to have the relations of FIGS. 8, 9, 10, and 11 in order.

The carriage 6 is moved to the cleaning mechanism portion side (the side of an arrow B) from a state where the slider 10 as illustrated in FIG. 8 has been urged by the slider spring so as to be located on the recording area side (the side of an arrow A) and is at rest. Thus, a carriage contact portion 6*a* is come into contact with a slider projecting portion 10*a*. When the carriage 6 is further moved to the cleaning mechanism portion side, the slider 10 follows the carriage 6 and moves along the base cam surface 19*a*.

When the slider 10 moves to a position illustrated in FIG. 9 along the base cam surface 19*a*, the cam portion 14*a* provided for the cap holder 14 starts to be come into contact with the pressing portion 22*a* of a cover member 22 fixed to the base 19 in which the apparatus frame is set to a reference. When the slider 10 further moves along the base cam surface 19*a*, the cap holder cam portion 14*a* is pressed downward by the pressing portion 22*a* and rotates around a rotary axis of the cap holder 14 as a rotational center.

At the second capping position illustrated in FIG. 10, since the cap holder cam portion 14*a* is pressed downward, the cap 11 and one end of the color ink recording head 7 are separated so as to be away from each other and the adhering state is cancelled, so that an atmosphere communicating state is obtained. At this time, the cap 12 and the black ink recording head 8 are adhered and the head is capped.

The slider 10 moves to the first capping position illustrated in FIG. 11 along the base cam surface 19*a* from the state where the cap 11 and the color ink recording head 7 are not adhered (the second capping position) as illustrated in FIG. 10. Since a part of the cap holder cam portion 14*a* is a slope (slanting surface which is inclined to the moving direction of the carriage 6), the contact state of the cap holder cam portion 14*a* and the pressing portion 22*a* is cancelled and the color ink recording head 7 and the cap 11 are adhered. That is, when the carriage 6 is moved between the first capping position and the second capping position, the cap holder 14 moves vertically for the slider 10 while the slope is come into contact with the pressing portion 22*a*.

When the carriage 6 moves from the recording area side to the first capping position, first, the black ink recording head 8 enters the capping state at the second capping position from the state where the recording heads 7 and 8 and the caps 11 and 12 are away from each other. Subsequently, the color ink recording head 7 enters the capping state at the first capping position. A contact force between the black ink recording head 8 and the cap 12 at the time of capping is larger than a contact force between the color ink recording head 7 and the cap 11. When a plurality of caps and a plurality of recording heads are adhered, by sequentially adhering them as mentioned above, the contact force between the cap and the recording head can be dispersed and the driving load of the carriage can be dispersed.

Subsequently, the cap separating operation for separating the recording head and the cap from the state where the black ink recording head 8 and the color ink recording head 7 and the corresponding caps 12 and 11 have been adhered will be described.

At the first capping position illustrated in FIG. 11, the color ink recording head 7 and the black ink recording head 8 are adhered to the corresponding caps 11 and 12, respectively. When the carriage 6 is moved to the recording area side (the side of the arrow A in FIG. 11) from the above state, the slider 10 is urged by the slider spring and moves to the recording area side. At this time, since the carriage contact portion 6*a* is in contact with the slider projecting portion 10*a*, the slider 10 follows the carriage 6 and moves.

When the carriage 6 is further continuously moved to the recording area side, the cam portion 14*a* provided for the cap holder 14 starts to be come into contact with the pressing portion 22*a* of the cover member 22 fixed to the base 19. When the slider 10 further moves along the base cam surface 19*a*, the cap holder cam portion 14*a* is pressed downward by the pressing portion 22*a* and rotates around the rotary axis of the cap holder 14 as a rotational center. At the second capping position illustrated in FIG. 10, since the cap holder cam portion 14*a* is pressed downward, the cap 11 and one end of the color ink recording head 7 are separated so as to be away from each other and the adhering state is cancelled, so that the atmosphere communicating state is obtained.

When the carriage 6 is further moved to the recording area side, the contact state of the cap holder cam portion 14*a* and the pressing portion 22*a* is cancelled and the black ink recording head 8 and the cap 12 are separated so as to be away from each other (refer to FIG. 9).

The urging force adapted to urge the slider 10 to the recording area side by the slider spring (urging unit) is set so as to be larger than the load in the carriage moving direction that is caused by the contact between the cap holder cam portion 14*a* and the pressing portion 22*a*. Therefore, the slider 10 is naturally moved and returned to the position where the contact between the cap holder cam portion 14*a* and the pressing portion 22*a* is cancelled.

When the carriage 6 moves from the first capping position to the recording area side, first, the capping state of the color ink recording head 7 is cancelled from the state where the recording heads 7 and 8 and the caps 11 and 12 are adhered. Subsequently, the capping state of the black ink recording head 8 is cancelled. When a plurality of caps and a plurality of recording heads are separated from the state where they are adhered, it is achieved by sequentially separating them as mentioned above that the separating force between the cap and the recording head can be dispersed and the driving load of the carriage can be dispersed. As mentioned above, since the contact force between the black ink recording head 8 and the cap 12 is larger than the contact force between the color ink recording head 7 and the cap 11, at the time of the separation in which the capping is cancelled, the recording head and the cap whose contact force is smaller are separated first. The larger the contact force is, the more the recording head and the cap are strongly adhered. Therefore, the force that is required for the separation also increases. Since the recording head and the cap whose separating force is smaller are separated first, the capping can be cancelled by the smaller driving force.

Figure 14:
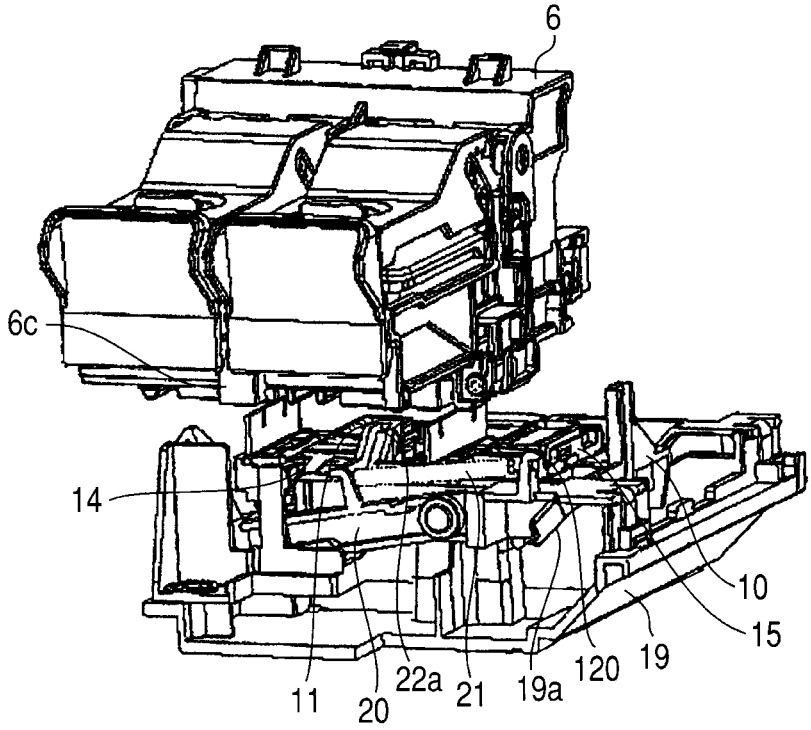
FIG. 14 is a schematic diagram illustrating a positional relation between a carriage and the cleaning mechanism portion in the state where the slider is urged to the recording area side and is a diagram seen from the upper surface side.
Figure 15:
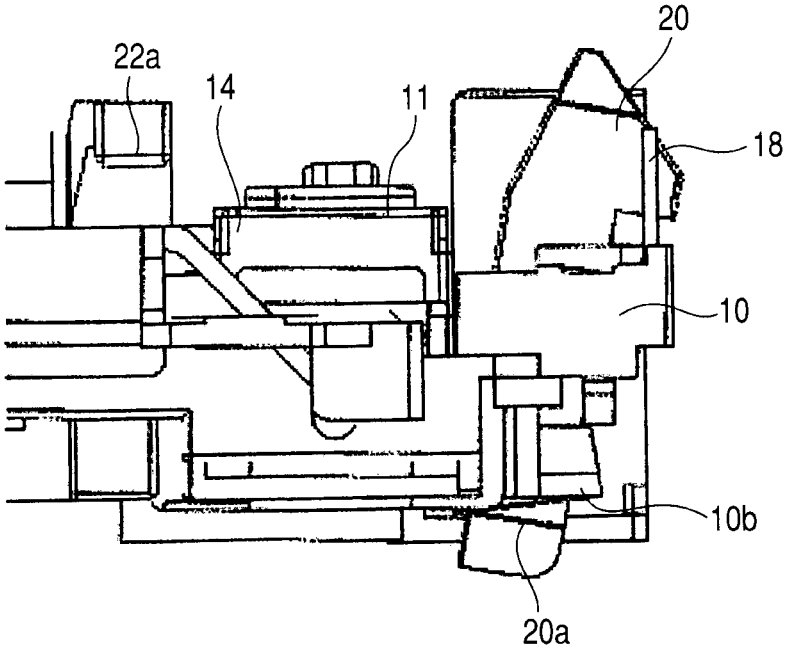
FIG. 15 is a schematic diagram illustrating a positional relation between the slider and a blade trigger lever in the state where the slider is urged to the recording area side and is a diagram seen from the rear side.

The wiping operation will now be described with reference to FIGS. 14 to 18. FIG. 14 illustrates the carriage 6 and the cleaning mechanism portion in the state where the carriage 6 exists out of the cleaning mechanism area. FIG. 15 is a rear view illustrating a relation between the slider 10 and a blade trigger lever 20. The slider 10 is at rest in a state where it bumps against the side surface of the base 19 as illustrated in FIG. 8 by the action of the slider spring. A force acts on the blade trigger lever 20 in the upward rotating direction by a blade trigger lever spring 21. At this time, a blade trigger lever retaining portion 20*a* is come into contact with a slider retaining portion 10*b* and the position of the blade trigger lever 20 is restricted and held in a state as illustrated in FIG. 15.

Figure 16:
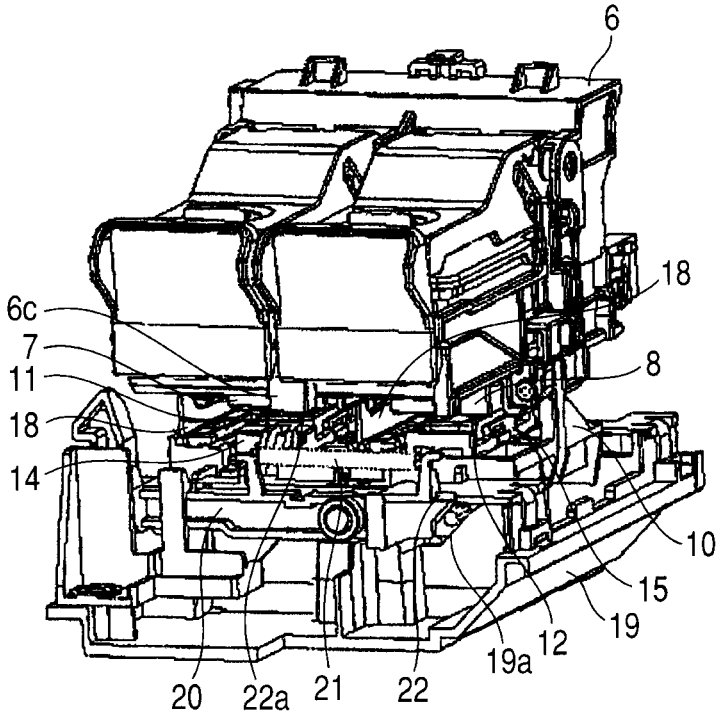
FIG. 16 is a schematic diagram illustrating a positional relation between the carriage and the cleaning mechanism portion in a state where the slider is located at a wiping start position and is a diagram seen from the upper surface side.
Figure 17:
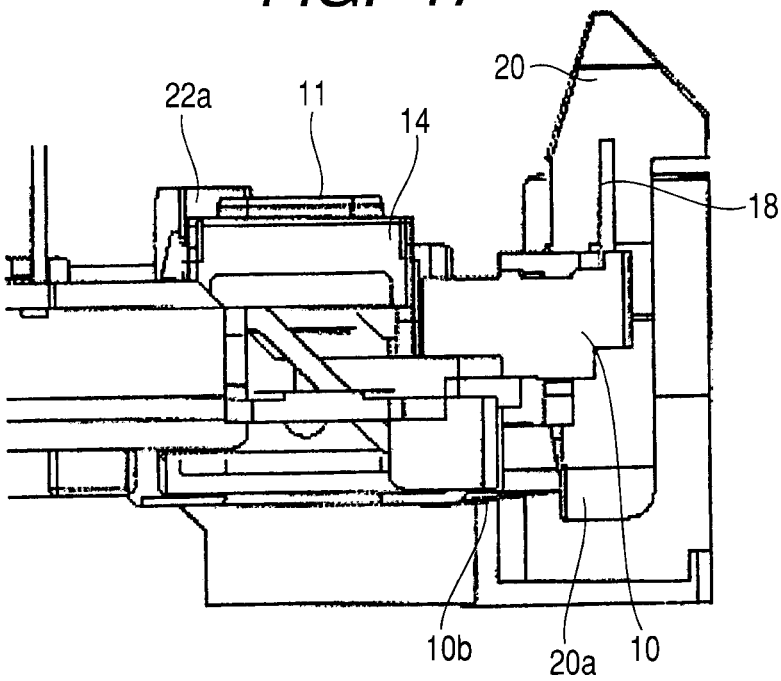
FIG. 17 is a schematic diagram illustrating a positional relation between the slider and the blade trigger lever in the state where the slider is located at the wiping start position and is a diagram seen from the rear side.
Figure 18:
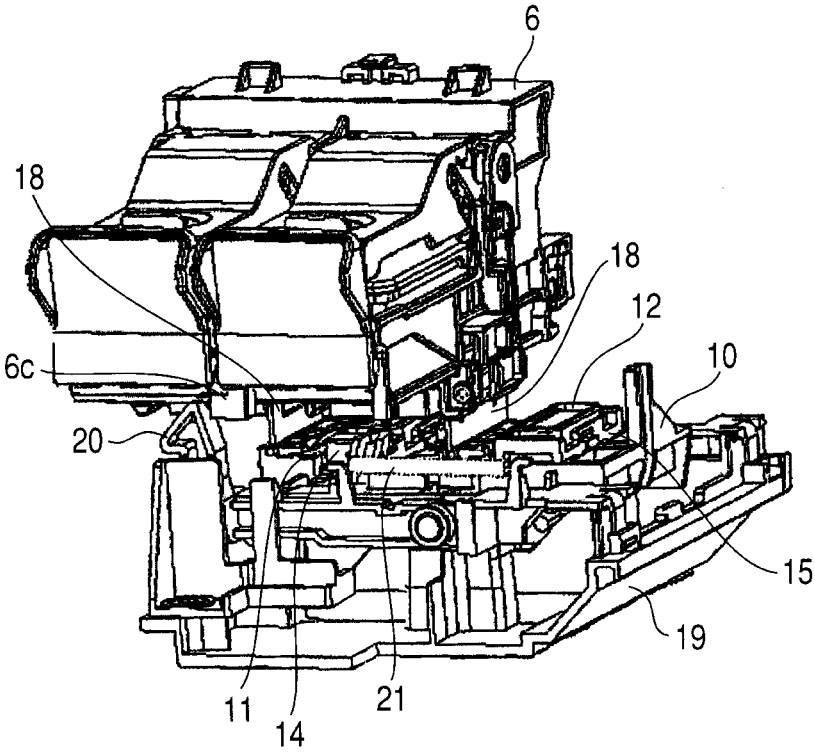
FIG. 18 is a schematic diagram illustrating a positional relation between the carriage and the cleaning mechanism portion in a state where the carriage is located at a wiping end position and is a diagram seen from the upper surface side.

FIG. 16 illustrates the carriage 6 and the cleaning mechanism portion at the time when the carriage 6 is located at a wiping start position. FIG. 17 is a rear view illustrating the relation between the slider 10 and the blade trigger lever 20. FIG. 18 illustrates the carriage 6 and the cleaning mechanism portion at the time when the carriage 6 is located at a wiping end position.

The carriage 6 moves to the cleaning mechanism side and the slider 10 follows the carriage 6 and moves to the wiping start position (wipe trigger position) illustrated in FIG. 16. The blade trigger lever 20 rotates until the contact between the blade trigger lever retaining portion 20*a* and the slider retaining portion 10*b* is cancelled and the lever collides with a bump portion of the cover member 22.

After that, when the carriage 6 is returned to the recording area side, since the slider 10 is held in a state as illustrated in FIG. 17 by the blade trigger lever 20, the tracking operation of the carriage 6 and the slider 10 is finished. When the carriage 6 is continuously moved to the recording area side, the wiping operation of the nozzle surface of each recording head is executed by a blade 18 provided for the slider 10. The carriage 6 is further continuously moved to the recording area side and is moved to the wiping end position illustrated in FIG. 18. At this time, a lever releasing portion 6*c* of the carriage 6 acts so as to push down an upper front edge of the blade trigger lever 20 in the downward rotating direction. Thus, the holding state of the slider 10 and the blade trigger lever 20 is cancelled and the slider 10 urged to the recording area side by the urging force of the slider spring is returned to a settled position illustrated in FIG. 8.

Subsequently, the sucking recovery operation of the black ink recording head 8 and the color ink recording head 7 will be described. In a state where the slider 10 has been urged so as to be located to the recording area side, as a previous operation for sucking recovery, the pumps are driven to a position where the pump tubes 13*a* and 13*b* are crushed by the inner wall of the pump base 40 and the pump roller 44.

In the case of executing the sucking recovery of only the black ink recording head 8, the carriage 6 is moved so that the slider 10 reaches the second capping position illustrated in FIG. 10. The black ink recording head 8 drives the pump in the capping state so as to generate the negative pressure in the cap 12, thereby sucking the black ink. Since the color ink recording head 7 is not adhered, the color ink is not sucked and the unnecessary ink sucking can be reduced. After that, when the carriage 6 is moved to the recording area side, the wiping operation is executed and the nozzle surface of the black ink recording head 8 is cleaned.

In the case of executing the sucking recovery from both of the black ink recording head 8 and the color ink recording head 7, the carriage 6 is moved so that the slider 10 reaches the first capping position illustrated in FIG. 11. In the state where the black ink recording head 8 and the color ink recording head 7 have been capped, by driving the pumps and generating the negative pressure in the caps 12 and 11, the black ink and the color ink are sucked. After that, when the carriage 6 is moved to the recording area side, the wiping operation is executed and the nozzle surfaces of the black ink recording head 8 and the color ink recording head 7 are cleaned.

The foregoing embodiment has the construction in which the two recording heads are mounted on the carriage 6, the nozzle of the black ink is provided for one of the recording heads, and the nozzle of the color ink is provided for the other recording head. The invention is not limited to such a construction but the invention can be applied to any printing apparatus so long as it is the ink jet recording apparatus irrespective of the number of recording heads, a layout of the recording heads, and a kind, a nature, and the like of the ink which are used, and similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-204522, filed Aug. 7, 2008, and Japanese Patent Application No. 2009-118976, filed May 15, 2009 which are hereby incorporated by reference herein in their entireties.

What is claimed is:

1. An ink jet recording apparatus comprising:

a carriage on which a first recording head and a second recording head are mounted;

a first cap which can seal the first recording head;

a first cap holder which holds the first cap;

a second cap which can seal the second recording head;

a slider on which the first cap holder is mounted rotatably around a rotary axis as a rotational center and on which the second cap is mounted, said slider being configured to follow the carriage and move in a moving direction of the carriage and in a direction which the caps come in to contact or separate from the recording heads; and a pressing portion fixed on an apparatus frame, wherein the first cap seals the first recording head and the second cap seals the second recording head when the carriage moves to a first position, and the second cap seals the second recording head but the first cap does not seal the first recording head when the carriage moves to a second position, and wherein when the carriage moves to the second position, the pressing portion comes into contact with the first cap holder and the first cap holder rotates around the rotary axis as a rotational center.

2. An apparatus according to claim 1, wherein when the carriage moves from the recording area to the first position, an apparatus state is changed from a third state where the first recording head and the first cap are not contacted and the second recording head and the second cap are not contacted to a second state where the second recording head and the second cap are contacted and the first recording head and the first cap are not contacted and, subsequently, changed to a first state where the first recording head and the first cap are contacted and the second recording head and the second cap are contacted, and when the carriage moves from the first position to the recording area, the state is changed from the first state to the second state and, subsequently, changed to the third state.

3. An apparatus according to claim 1, further comprising a cam portion which contacts with the pressing portion to be formed in part of the first cap holder, the cam portion having a slope with respect to the moving direction of the carriage, and when the carriage moves between the first position and the second position, the first holder moves vertically with respect to the slider while the slope contacts with the pressing portion.

4. An apparatus according to claim 1, further comprising an urging unit for urging the slider to a recording area side in the moving direction of the carriage, wherein an urging force by the urging unit is larger than a load in the moving direction that is caused by the contact of a part of the first cap holder and the pressing portion.

5. An apparatus according to claim 1, wherein a contact pressure at the time when the first cap seals the first recording head is smaller than a contact pressure at the time when the second cap seals the second recording head.

6. An apparatus according to claim 1, further comprising a pump for supplying a negative pressure in the first cap and the second cap, wherein the negative pressure is supplied to the first cap and the second cap when the carriage is in the first position or the second position.

7. An apparatus according to claim 1, further comprising a wiping unit which is provided on the slider and cleans the first recording head and the second recording head, wherein while the slider moves to the recording area side, the first recording head and the second recording head are wiped.

8. An apparatus according to claim 1, wherein the first recording head is a recording head for color ink and the second recording head is a recording head for black ink.

9. An apparatus according to claim 8, wherein the first recording head is a recording head for dye ink and the second recording head is a recording head for pigment ink.

* * * * *